United States Patent [19]

Curtis et al.

[11] Patent Number: 4,952,182

[45] Date of Patent: Aug. 28, 1990

[54] NOISE ATTENUATING EXHAUST RELIEF SYSTEM FOR AN OUTBOARD MOTOR

[75] Inventors: Mark D. Curtis, Oshkosh; James L. Wagner, Neenah, both of Wis.

[73] Assignee: Brunswick Corp., Skokie, Ill.

[21] Appl. No.: 377,024

[22] Filed: Jul. 7, 1989

[51] Int. Cl.[5] ..... B63H 21/26

[52] U.S. Cl. ..... 440/89; 60/312; 181/260

[58] Field of Search ..... 440/88, 89; 60/310, 60/312; 181/251, 260; 123/41.31

[56] References Cited

U.S. PATENT DOCUMENTS

| | | | |
|---|---|---|---|
| 3,967,446 | 7/1976 | Harralson et al. | 440/89 |
| 4,014,282 | 3/1977 | Kollman | 440/89 |
| 4,421,490 | 12/1983 | Nakahama | 440/89 |
| 4,668,199 | 5/1987 | Freund et al. | 440/89 |

*Primary Examiner*—Joseph F. Peters, Jr.

*Assistant Examiner*—Jesûs D. Sotelo

*Attorney, Agent, or Firm*—Andrus, Sceales, Starke & Sawall

[57] ABSTRACT

An exhaust relief system for an outboard motor includes an exhaust chamber into which exhaust is discharged from the engine. A first passage in communication with the exhaust chamber provides contraction of the exhaust as the exhaust passes rearwardly, from which the exhaust is discharged into an expansion chamber which substantially surrounds the exhaust chamber. From the expansion chamber, the exhaust is routed through and contracted into a second passage in communication with the expansion chamber, after which it is discharged to atmosphere. The tortuous path provided by the exhaust relief system of the invention, along with the repeated expansion and contraction of the exhaust as it flows to atmosphere, provides a muffling effect at idle operation.

14 Claims, 3 Drawing Sheets

NOISE ATTENUATING EXHAUST RELIEF SYSTEM FOR AN OUTBOARD MOTOR

BACKGROUND AND SUMMARY

This invention relates to an outboard motor, and more particularly to a silencing exhaust relief system for an outboard motor.

In an outboard motor employing a vertical drive shaft two-stroke cycle engine, it is common to discharge exhaust into a chamber formed in the drive shaft housing for providing exhaust tuning to the engine. An exhaust discharge passageway is in communication with the exhaust chamber for discharging exhaust therefrom to a submerged exhaust outlet, typically through the propeller hub. This arrangement has been found to provide highly satisfactory operation under most operating conditions in which sufficient exhaust pressure exists to ensure discharge of exhaust through the submerged outlet. However, under some operating conditions, such as at idle or in reverse operation, there is insufficient exhaust pressure within the exhaust system to expel water therefrom. Accordingly, water collects within the exhaust discharge passage downstream of the exhaust chamber, as well as in the chamber itself. In such situations, the outlet of exhaust into the exhaust chamber is typically submerged.

Various systems have been devised for providing relief of back pressure caused in the abovedescribed situation. Two such systems are disclosed in Harralson et al U.S. Pat. No. 3,967,446 and Freund et al U.S. Pat. No. 4,668,199, the disclosures of which are hereby incorporated by reference. The present invention provides yet another satisfactory system for relieving exhaust back pressure during idle, low speed or reverse operation, and also provides noise attenuation under such circumstances.

In accordance with the invention, an exhaust relief system is provided for an outboard motor. The outboard motor includes a power head having an exhaust discharge opening and a drive shaft housing mounted below and supporting the power head. An exhaust chamber is provided within the drive shaft housing, and an exhaust flow path is disposed downstream of and in communication with the exhaust chamber for providing a submerged exhaust outlet. A primary exhaust discharge passage is in communication with the power head exhaust discharge opening, and has an outlet for discharging exhaust into the exhaust chamber. The exhaust relief system is operable when the exhaust flow path is filled with water under certain operating conditions to prevent exhaust flow therethrough. The exhaust relief system comprises a first passage having an inlet at the upper end of the exhaust chamber and in communication with the exhaust chamber for receiving exhaust therefrom. An expansion chamber is associated with the drive shaft housing, and has an inlet for receiving exhaust from the first passage. A second passage is provided at the upper end of the exhaust chamber, and has an inlet for receiving exhaust from the expansion chamber. An outlet is in communication with the second passage for discharging exhaust to atmosphere. In a preferred embodiment, a drive shaft housing plate is adapted for placement at the upper end of the drive shaft housing. The first and second passages are preferably formed in the drive shaft housing plate, as are the inlets thereto. The drive shaft housing plate forms the upper wall of the exhaust chamber, as well as of the expansion chamber. An exhaust extension plate is adapted for placement between the drive shaft housing plate and the power head. The lower face of the exhaust extension plate preferably forms the upper wall of the first and second passages. The expansion chamber is preferably an annular space formed about substantially the entire periphery of the exhaust chamber. The inlet to the expansion chamber and the inlet to the second passage are arranged so as to be disposed substantially opposite each other. With this arrangement, it is assured that exhaust within the expansion chamber travels a maximum distance prior to entry into the second passage inlet, in order to attenuate noise as much as possible.

The invention thus provides a tortuous path having a series of expansion and contraction areas for dissipating energy in the form of noise from the exhaust as is it is discharged through the relief system. Accordingly, quiet operation at idle is achieved.

BRIEF DESCRIPTION OF THE DRAWINGS

The drawings illustrate the best mode presently contemplated of carrying out the invention.

In the drawings.

DETAILED DESCRIPTION OF THE PRIOR ART

Figure 1:
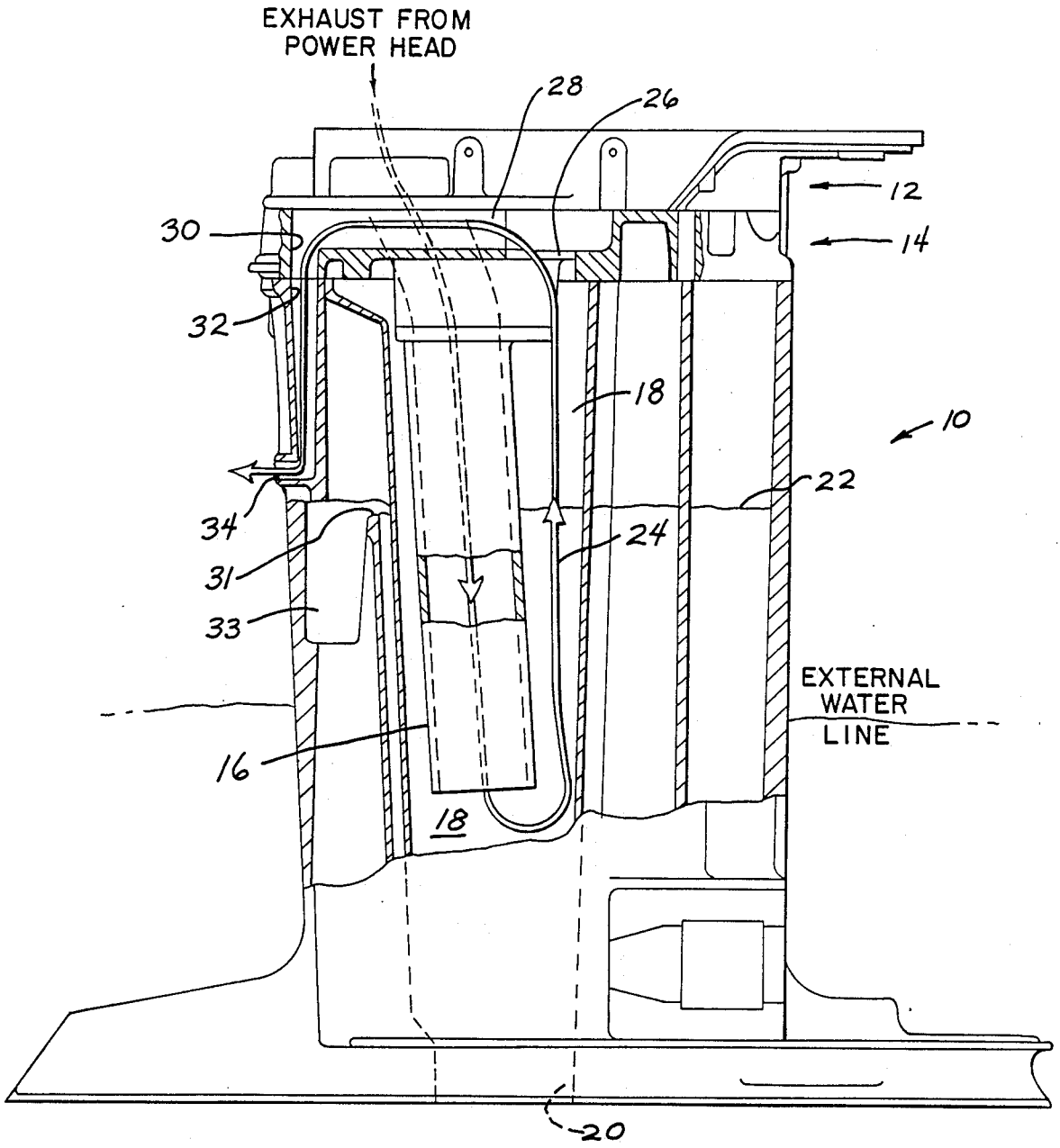
FIG. 1 PRIOR ART
FIG. 1 is a starboard side elevation view, partially in section, of a drive shaft housing for use in an outboard motor, with a drive shaft housing plate and an exhaust extension plate mounted to the upper end of the drive shaft housing, showing a prior art system for providing exhaust relief.

FIG. 1 illustrates an outboard motor drive shaft housing 10, adapted for interposition between a power head (not shown) and a lower unit (not shown). As is known, drive shaft housing 10 houses a drive shaft (not shown) driven by the power head for imparting rotation to a propeller.

An exhaust extension plate, shown at 12, and a drive shaft housing plate, shown at 14, are adapted for placement between the upper end of drive shaft housing 10 and the power head. Exhaust extension plate 12 includes a depending exhaust extension tube 16. With exhaust extension plate 12 and drive shaft housing plate 14 mounted to drive shaft housing 10, exhaust extension tube 16 discharges exhaust into an exhaust chamber 18 provided within drive shaft housing 10. Exhaust chamber 18 communicates with an exhaust outlet 20 formed in the lower end of drive shaft housing 10. As is known, exhaust discharged through outlet 20 is typically routed through the lower unit connected to the lower end of drive shaft housing 10 in such a manner that exhaust is ultimately discharged below the waterline.

When the boat is at idle or operating at low speed or reverse operation, water is typically contained within exhaust chamber 18 at a higher elevation than the external waterline. Such elevated water as contained within exhaust chamber 18 by inner walls 31 of water discharge passage 33 and is shown at 22. When this occurs, there is insufficient pressure from exhaust passing through exhaust tube 16 to expel water from exhaust chamber 18. Accordingly, exhaust discharged from exhaust tube 16 travels upwardly within chamber 18, as shown at 24, and through an inlet 26 formed in the underside of drive shaft housing plate 14, and into a passage 28 formed therein. From passage 28, exhaust passes through an outlet 30 formed in drive shaft housing plate 14 and through a discharge passage 32 formed in drive shaft housing 10 to a discharge outlet 34 for venting to atmosphere.

Passage 28 is in the form of an upwardly facing channel provided in drive shaft housing plate 14, with the upper wall of passage 28 being formed by the underside of exhaust extension plate 12. In a typical prior art installation, two exhaust relief passageways are provided; one on the starboard side of drive shaft housing plate 14, as shown, and the other in the port side of drive shaft housing 14. A separate passage (28), exhaust discharge passage (32), and exhaust outlet (34), are provided for each exhaust relief passageway.

Figure 2:
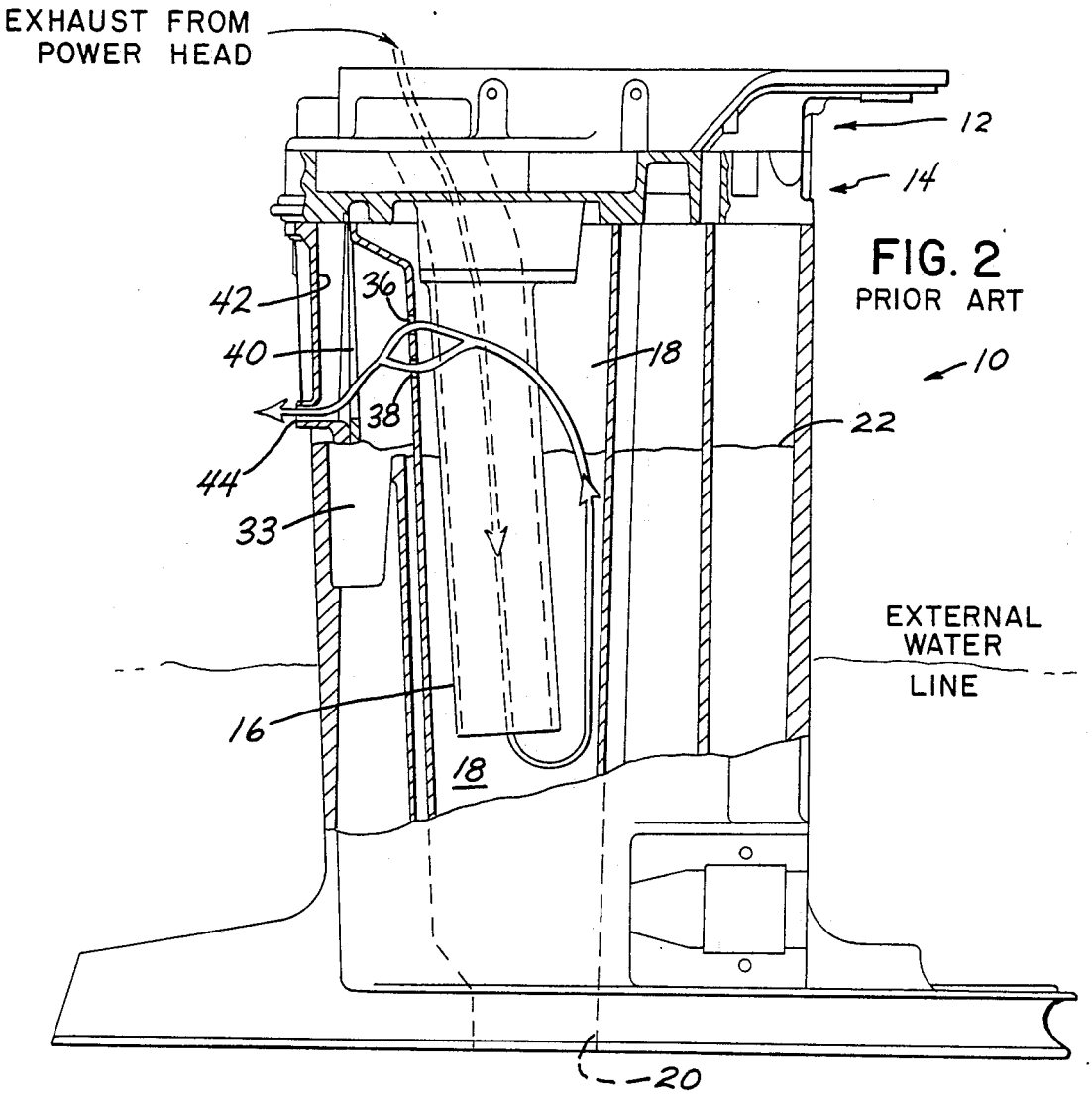
FIG. 2 PRIOR ART
FIG. 2 is a view similar to FIG. 1, showing another prior art exhaust relief system.

FIG. 2 illustrates another prior art relief system, and like reference characters will be used where possible to facilitate clarity. In this system, passages such as 36, 38 are formed in the upper rear wall of exhaust chamber 18. Exhaust discharged from exhaust tube 16 flows upwardly through chamber 18 and through passages 36, 38. Such exhaust then flows rearwardly through a slot 40 and into discharge passage 42 for ultimate discharge to atmosphere through discharge outlet 44.

The system shown in FIG. 1 has been found to provide unsatisfactory engine performance at idle conditions. The FIG. 2 system provides satisfactory engine performance, but results in a high level of noise during operation.

DETAILED DESCRIPTION OF THE PREFERRED EMBODIMENT

Figure 5:
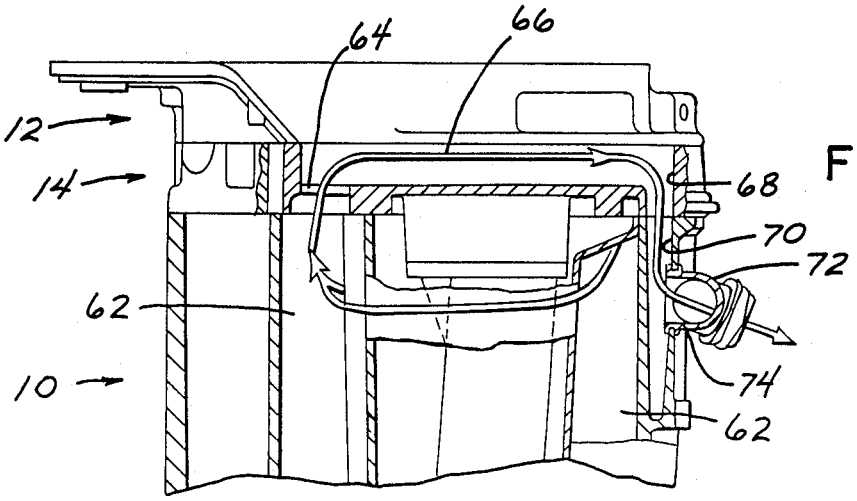
FIG. 5 is a port side elevation view, partially in section showing the exhaust relief system of the invention.
Figure 3:
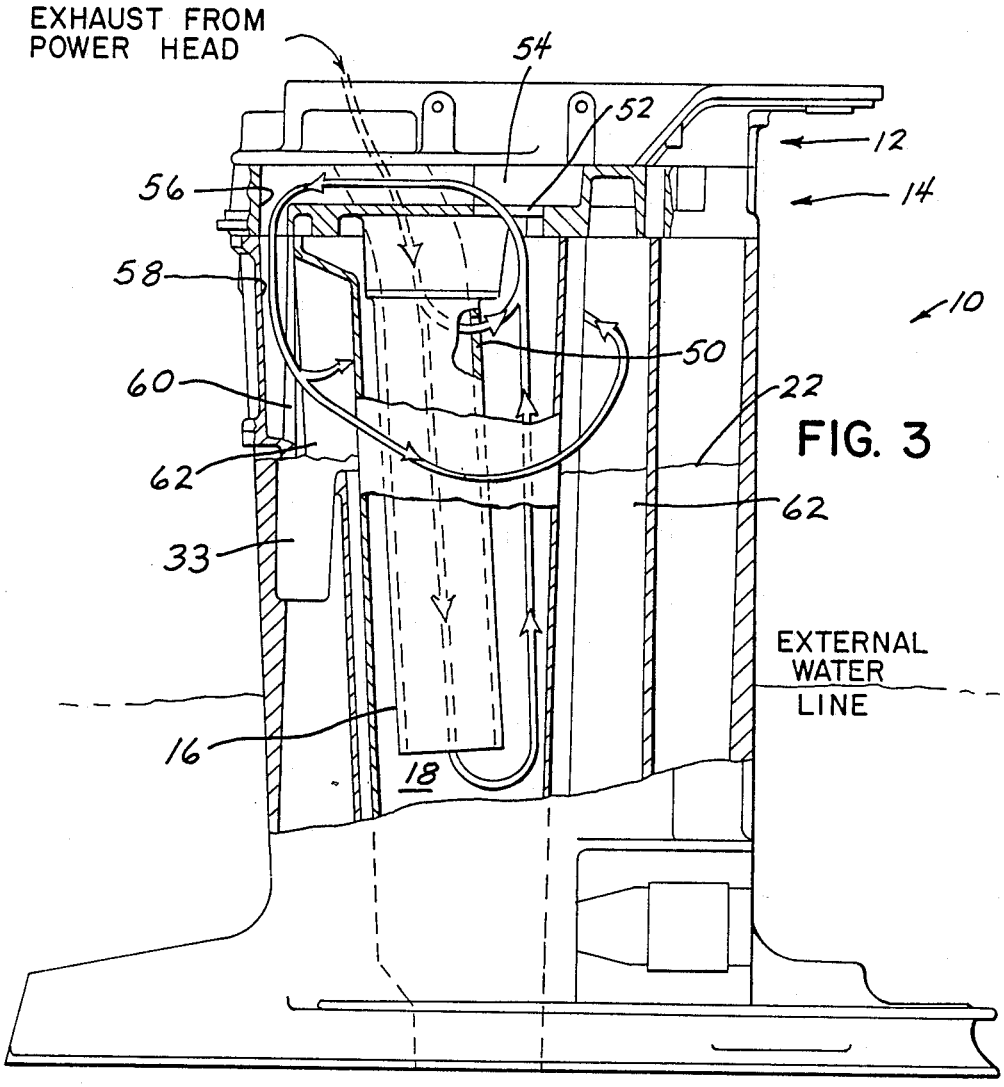
FIG. 3 is a view similar to FIGS. 1 and 2, showing the exhaust relief system of the invention.
Figure 4:
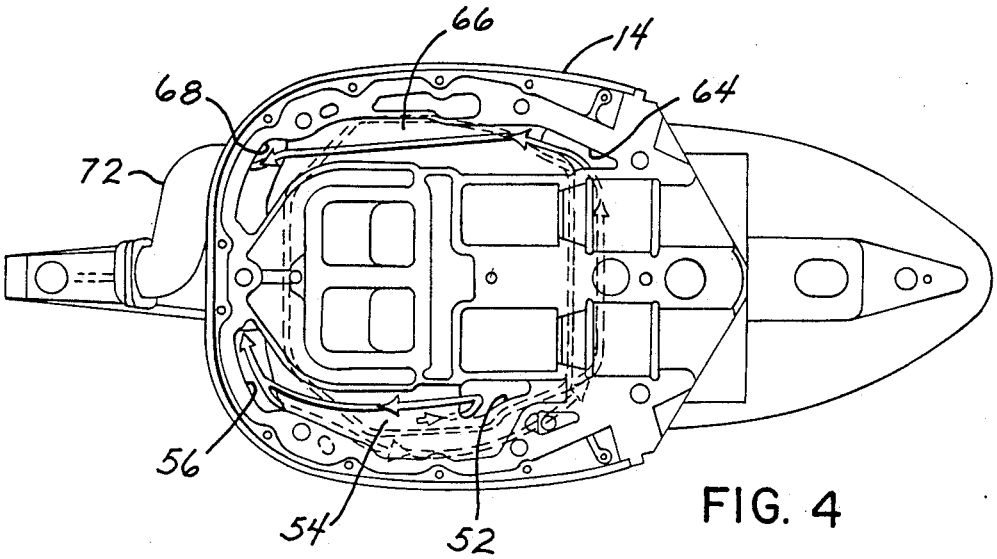
FIG. 4 is a top plan view of the assembly of FIG. 3, with the exhaust extension plate removed.

FIGS. 3–5 illustrate the relief system of the invention, and like reference characters will again be used where possible to facilitate clarity.

As shown, an opening 50 is provided in the upper front wall of exhaust tube 16. Opening 50 provides an alternate route for exhaust discharge other than the discharge end of exhaust tube 16. During idle or reverse operation, when exhaust gas pressures are low and exhaust cavity 18 is filled with water to a level above the discharge end of exhaust tube 16, exhaust is discharged either through opening 50 or through the discharge end of exhaust tube 16 and upwardly through exhaust cavity 18. As shown, exhaust discharged in this manner then merges and flows upwardly through an opening 52 formed in drive shaft housing plate 14 and into a passage 54 formed in the starboard side of drive shaft housing 14. Passage 54 is in the form of an upwardly facing channel formed in drive shaft housing plate 14, and the upper wall of passage 54 is formed by the underside of exhaust extension plate 12 when mounted to drive shaft housing plate 14. Exhaust entering passage 54 through inlet 52 then flows rearwardly as shown, and downwardly through an outlet 56. After discharge from passage 54, such exhaust then flows into a passage 58 in communication with outlet 56, and through a slot 60 into an expansion chamber 62. Expansion chamber 62 is in the form of an annular space surrounding the exterior of exhaust chamber 18. From expansion chamber 62, exhaust flows upwardly through an inlet 64 (FIG. 5) formed in the port side of drive shaft housing plate 14 and into a passage 66. The exhaust then flows rearwardly through passage 66 and an outlet 68 into a discharge exhaust passage 70. Exhaust then vents to atmosphere from discharge exhaust passage 70 through a bellows 72 fitted within an opening 74 provided in the rear wall of drive shaft housing 10.

As shown, passage 66 is constructed similarly to passage 54 by forming an upwardly facing channel in drive shaft housing plate 14 and placing exhaust extension plate 12 thereover so that the upper wall of passage 66 is formed by the underside of exhaust extension plate 12.

With reference to FIG. 4, it is seen that first passage outlet 56 and second passage inlet 64 are disposed opposite each other, with exhaust cavity 18 being disposed therebetween. In this manner, exhaust entering expansion chamber 62 flows around the exterior of exhaust cavity 18 the maximum distance possible before entering second passage inlet 64, so as to dissipate as much energy as possible from exhaust flowing through expansion chamber 18.

The exhaust relief system of the invention provides a system in which exhaust is first expanded within exhaust chamber 18, and then contracted within first passage 54. Exhaust from passage 54 is then again expanded into expansion chamber 62. From expansion chamber 62, the exhaust is then again contracted in second passage 66, after which it is again expanded when vented to atmosphere through bellows 72. With this system, the repeated expansion and contraction of exhaust flowing through the exhaust relief system dissipates energy from the exhaust in the form of noise, and acts as a silencing or muffler system. It has been found that, with the relief system of the invention, a reduction of 50% of noise at idle operation is achieved relative to the system as shown in FIG. 2. Sufficient back pressure is relieved so that engine performance is not adversely affected.

Various alternatives and modifications are contemplated as being within the scope of the following claims particularly pointing out and distinctly claiming the subject matter regarded as the invention.

I claim:

1. An exhaust idle relief system for an outboard motor, said outboard motor including a power head having an exhaust discharge opening; a drive housing mounted below and supporting said power head; an exhaust chamber provided within said drive housing; an exhaust flow path downstream of and in communication with said exhaust chamber and providing a submerged exhaust outlet; and a primary exhaust discharge passage in communication with said power head exhaust discharge opening and having an outlet for discharging exhaust into said exhaust chamber; wherein said exhaust flow path is filled with water under certain operating conditions to prevent exhaust flow therethrough; said exhaust relief system comprising:

a first passage having an inlet at the upper end of said exhaust chamber and in communication with said chamber for receiving exhaust therefrom when water in said exhaust flow path prevents exhaust flow therethrough;

an expansion chamber surrounding said exhaust chamber and having an inlet for receiving exhaust from said first passage;

a second passage having an inlet for receiving exhaust from said expansion chamber; and an outlet for discharging exhaust to atmosphere from said second passage.

2. The exhaust idle relief system of claim 1, further comprising a plate adapted for placement at the upper end of said drive housing, said plate forming the upper wall of said exhaust chamber, and wherein said first passage and the inlet thereto and the inlet to said expansion chamber are formed in said plate.

3. The exhaust idle relief system of claim 2, wherein said second passage and the inlet thereto are formed in said plate.

4. The exhaust idle relief system of claim 3, wherein said exhaust outlet is provided in the outer wall of said drive housing, and further comprising an outlet passage extending from said second passage to said outlet for communicating exhaust therebetween.

5. The exhaust idle relief system of claim 4, wherein said outlet passage is formed in said drive housing.

6. The exhaust idle relief system of claim 1, wherein said expansion chamber comprises an annular space provided about substantially the entire periphery of said exhaust chamber.

7. The exhaust idle relief system of claim 1, wherein said first and second passages are disposed above said expansion chamber.

8. An outboard motor, comprising:

a power head having an exhaust discharge opening;

a drive housing including an exhaust chamber;

plate means adapted for interposition between said power head and said drive housing for mounting said power head thereto, said plate means including an exhaust passage in communication with said power head exhaust discharge opening;

a primary exhaust discharge passage in communication with said plate means exhaust passage for discharging exhaust into said exhaust chamber through a primary exhaust outlet;

exhaust discharge means in communication with said exhaust chamber and including a submerged primary exhaust outlet, wherein said exhaust discharge means is filled with water under certain operating conditions to prevent exhaust flow therethrough; and an exhaust relief system for discharging exhaust when water in said exhaust discharge means prevents exhaust flow therethrough, comprising:

a first passage provided in said plate means and having an inlet in communication with the upper end of said exhaust chamber;

an expansion chamber provided in said drive shaft housing and having an inlet in communication with said first passage;

a second passage provided in said plate means and having an inlet in communication with said expansion chamber; and an exhaust relief outlet for discharging exhaust to atmosphere from said second passage.

9. The outboard motor of claim 8, wherein said plate means includes a drive housing plate mounted to the upper end of said drive housing and an exhaust extension plate mounted between said drive housing plate and said power head, and wherein said first and second passages are formed at the interface of said drive housing plate and said exhaust extension plate.

10. The outboard motor of claim 9, wherein said first and second passages comprise channels formed in said drive housing plate, and wherein the upper wall of each said passage is formed by said exhaust extension plate when mounted to said drive shaft housing plate.

11. The outboard motor of claim 8, wherein said expansion chamber comprises an annular space substantially surrounding said exhaust chamber.

12. The outboard motor of claim 8, wherein the inlet to said expansion chamber and the inlet to said second passage are arranged such that one inlet is disposed toward the front of said drive housing and one inlet is disposed toward the rear of said drive housing.

13. The outboard motor of claim 12, wherein said first and second passages are arranged on opposite sides of said plate means such that said expansion chamber inlet and said second passage inlet are disposed opposite one another.

14. The outboard motor of claim 8, further comprising a discharge passage provided in said drive housing in communication with said second passage, and wherein said exhaust relief outlet comprises an opening formed in said drive housing in communication with said discharge passage.

* * * * *